US005725051A

United States Patent [19]

Veltkamp

[11] Patent Number: 5,725,051

[45] Date of Patent: Mar. 10, 1998

[54] HEAT EXCHANGER

[75] Inventor: Wessel Bart Veltkamp, Son, Netherlands

[73] Assignee: Level Energietechniek B.V., Son, Netherlands

[21] Appl. No.: 424,463

[22] PCT Filed: Nov. 2, 1993

[86] PCT No.: PCT/NL93/00227

§ 371 Date: Jun. 29, 1995

§ 102(e) Date: Jun. 29, 1995

[87] PCT Pub. No.: WO94/10520

PCT Pub. Date: May 11, 1994

[30] Foreign Application Priority Data

Nov. 5, 1992 [NL] Netherlands ..... 92.01945

[51] Int. Cl.[6] ..... F28D 7/16

[52] U.S. Cl. ..... 165/165; 165/164

[58] Field of Search ..... 165/164, 165, 165/166

[56] References Cited

U.S. PATENT DOCUMENTS

| | | | |
|---|---|---|---|
| 3,608,629 | 9/1971 | Cowans . | |
| 3,804,162 | 4/1974 | Kugler et al. | 165/164 |
| 4,116,271 | 9/1978 | DeLepeleire | 165/166 |
| 4,379,487 | 4/1983 | Krakow | 165/165 |
| 4,601,332 | 7/1986 | Oda et al. | 165/165 |
| 4,913,776 | 4/1990 | Finnemore et al. | 165/166 |

FOREIGN PATENT DOCUMENTS

| | | | |
|---|---|---|---|
| 0 121 445 | 10/1984 | European Pat. Off. . | |
| 854 363 | 7/1949 | Germany . | |
| 959 917 | 3/1957 | Germany . | |
| 25 27 787 | 1/1976 | Germany . | |
| 243 087 | 2/1987 | Germany . | |
| 243 088 | 2/1987 | Germany . | |
| 243 089 | 2/1987 | Germany . | |
| 243 090 | 2/1987 | Germany . | |
| 243 091 | 2/1987 | Germany . | |
| 112376 | 9/1979 | Japan | 165/165 |
| 217193 | 9/1988 | Japan | 165/165 |
| 342 904 | 2/1972 | Sweden . | |
| 349 388 | 9/1972 | Sweden . | |
| 383 203 | 3/1976 | Sweden . | |
| 1080003 | 3/1984 | U.S.S.R. | 165/164 |
| 1 217 379 | 9/1968 | United Kingdom . | |
| 2 170 586 | 8/1986 | United Kingdom . | |
| 82/00194 | 1/1982 | WIPO . | |

*Primary Examiner*—Leonard R. Leo
*Attorney, Agent, or Firm*—Banner & Witcoff, Ltd.

[57] ABSTRACT

A heat exchanger comprising first and second type of ducts extending mutually parallel and at least partially mutually adjacent. The duct cross-sections are connected in a regular pattern, such that each separating wall is bounded on at least one side by a first type duct and on the other by a second type duct.

2 Claims, 6 Drawing Sheets

HEAT EXCHANGER

The invention relates to a heat exchanger comprising ducts of the first type and ducts of the second type, wherein ducts of both types are at least partly mutually adjacent.

Such heat exchangers are generally known.

An example of a heat exchanger is a recuperator which is used for instance to recover waste heat from a process in order hereby to lessen the heat (or cold) consumption. In a recuperator the media from which heat is extracted, respectively to which it is transferred, are mutually separated. This in contrast to a so-called regenerator wherein the heat is transferred via an intermediate heat capacity by causing both media to flow therethrough alternatingly.

Known heat exchangers are frequently embodied as so-called cross-current heat exchangers, plate heat exchangers or tube and shell heat exchangers, wherein the counterflow principle is applied.

These devices have in common that the required power can only be realized in a large volume. Another drawback lies in the fact that greater flow losses occur. Yet another drawback lies in the fact that the temperature distribution in such known heat exchangers often results in stresses in the material so that the choice of materials is limited. This results generally in increased cost.

Another drawback of the tube and shell heat exchanger is that a large number of pipes must be connected to a manifold, which results in higher costs, while in addition a uniform flow distribution is difficult to obtain on the shell side, whereby the efficiency is adversely affected. Another drawback is that the flow is too turbulent to obtain a sufficiently high heat transfer, whereby a high flow resistance and vibrations are generated.

From GB-A-2170586 a heat exchanger is known, comprising ducts of a first type and ducts of a second type, the ducts of both types having an identical cross-section, being parallel and at least partially mutually adjacent arranged in a housing, and in cross-section arranged in a regular pattern, the ducts being separated by separating walls wherein substantially each of the separating walls is bounded on at least one side by a duct of the first type and by a duct of the second type at the other side, the heat exchanger comprising at least one connecting piece adapted for connecting one end of the ducts of the first type to a first connection and one end of the ducts of the second type to a second connection.

However, in this prior art heat exchanger the ducts of the first type and of the second type have a different configuration.

The object of the invention is to provide a heat exchanger wherein the greatest possible part of the energy is transferred from the heat generating medium to the heat absorbing medium, wherein the above stated drawbacks are obviated.

This object is achieved in that substantially each of the ducts of the first type is at all its sides adjacent to a duct of the second type.

Further it is noted that from GB-A-2 170 586 a heat exchanger is known, in which the ducts of the first and the second types have the same cross-section and in which substantially each of the ducts of the first type is at all its sides adjacent to a duct of the second type. However, the ducts of both types are not connected with connecting pieces making a difference between the ducts of the first and the second types.

As a result of the steps according to the invention the heat transfer coefficient in the laminar flow and the heat transferring area increase considerably at a constant cross sectional area of the device in which the ducts are arranged. Due to the resulting large heat transferring power the temperature differences between the incoming and outgoing gas flows are small as seen in the cross section, so that due to the large heat exchanging surface area the density of the heat flow perpendicularly of the duct wall is low. The temperature gradient therefore extends substantially in the lengthwise direction of the ducts, whereby thermal tensile stresses in the material are avoided.

It has also been found that in the case of laminar flow in a duct the efficiency increases when the ducts have a small cross section. The total number of ducts is therefore large. These always mutually adjacent ducts of first and second type are arranged according to a regular pattern, for instance a chess board or a halma board, in order to cause each of the separating walls to be bounded on either side by ducts of different type.

For feed and discharge of the relevant media use is made of a connecting piece adapted for connecting one end of the ducts of the first type to a first connection and connecting one end of ducts of the second type to a second connection.

In preference such a connecting piece comprises connecting ducts which each connect onto an end of the ducts located on one side of the heat exchanger and which extend to a boundary plane, wherein the connecting ducts are separated in the manner of columns or rows into two groups of mutually parallel connecting ducts, and connecting ducts belonging to the first group each extend obliquely relative to ducts belonging to the second group such that on the boundary plane ducts belonging to the first group are offset relative to ducts belonging to the second group.

It has been found that such a heat exchanger is particularly effective in burners, for instance radiation burners, wherein the combustion gases are guided through the ducts of the first type and the fuel or air through ducts of the second type. Thus obtained is an effective pre-heating of the fuel or air and thus a high burner efficiency.

The present invention will be elucidated hereinbelow with reference to the annexed drawings, in which.

In FIGS. 1–4 the ducts of the first type and the second type are shown respectively hatched and in white.

Figure 1:
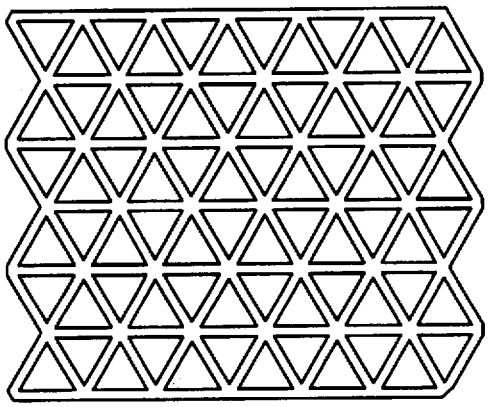
FIG. 1 shows a sectional view of a first embodiment of a heat exchanger according to the invention.

In the cross section shown in FIG. 1 it can be seen that the triangular section depicted there likewise results in a configuration in which each duct of the first type is bounded on all sides by a duct of the second type and vice versa.

Figure 2:
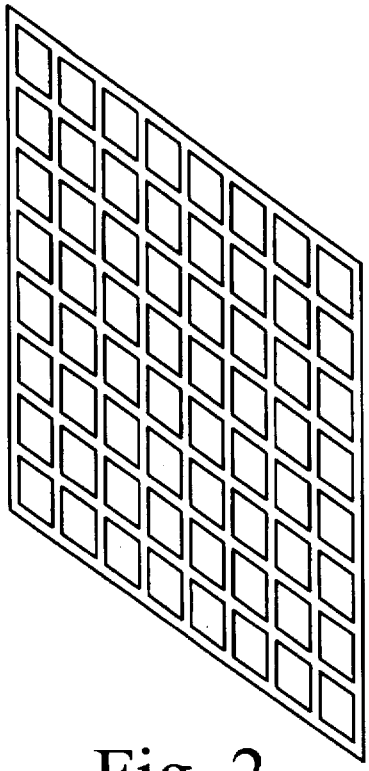
FIG. 2 shows a sectional view of a second embodiment of a heat exchanger according to the invention.

For the embodiment shown in FIG. 2 wherein the ducts each have a cross sectional parallelogram form, the same considerations apply.

Figure 3:
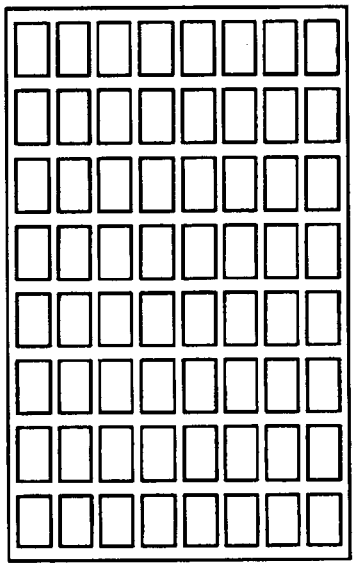
FIG. 3 is a sectional view of a third embodiment of a heat exchanger according to the invention.

The same is true for the embodiment in FIG. 3, wherein the ducts each have a cross section in the form of a rectangle; this embodiment has the advantage that connecting pieces which are used for supplying the relevant media to the ducts can be manufactured in an easier manner, which will be elucidated hereinbelow. Such a consideration also applies for the embodiment shown in FIG. 4.

Figure 4:
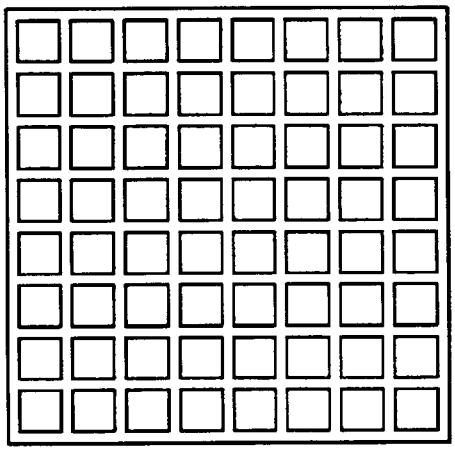
FIG. 4 is a sectional view of a fourth embodiment of a heat exchanger according to the invention.
Figure 5:
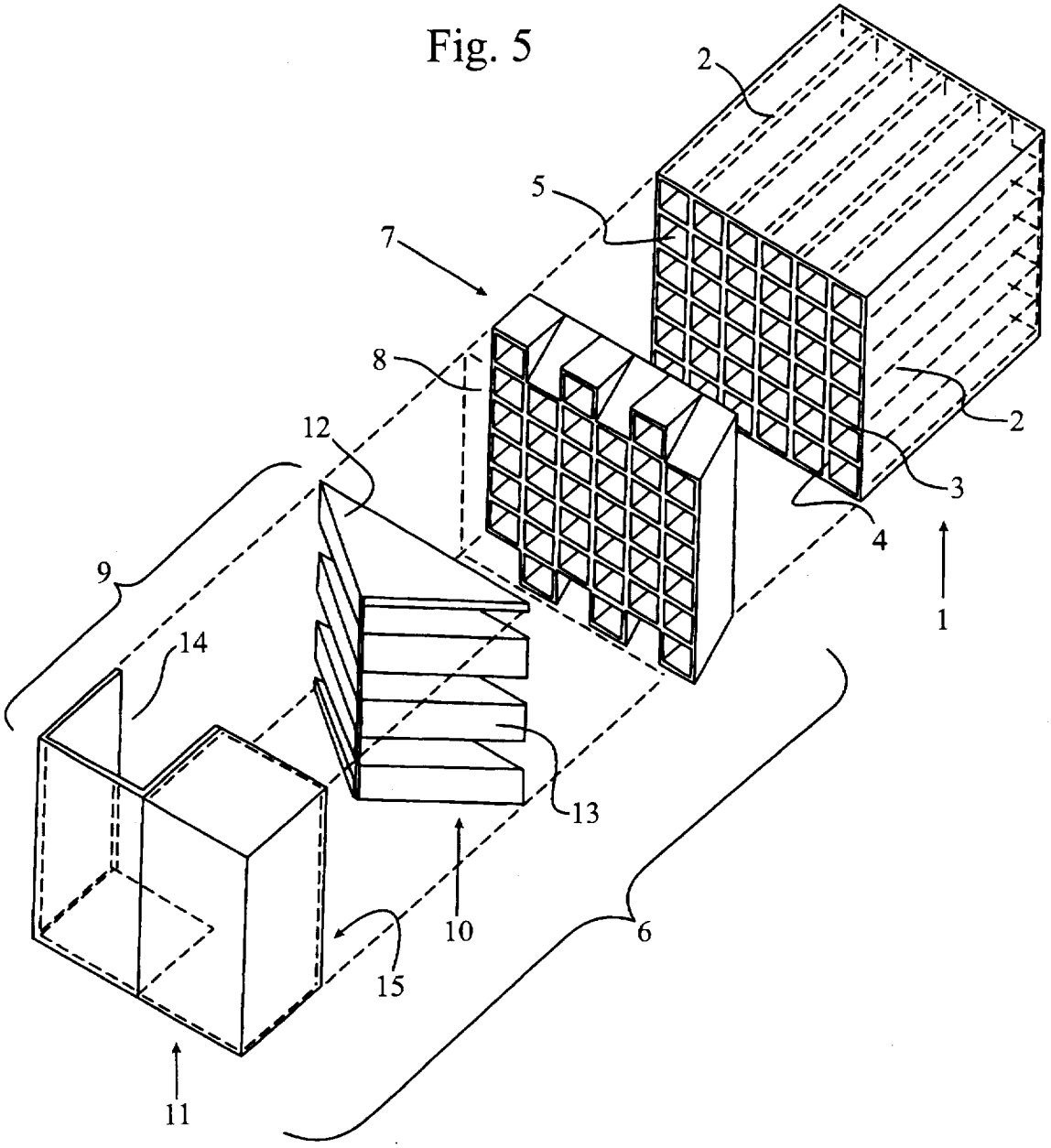
FIG. 5 shows a perspective view exploded in one dimension of the preferred embodiment of the heat exchanger according to the present invention.

The embodiment depicted in FIG. 4 is shown in more detail in FIG. 5. As can be seen from FIG. 5, the actual heat exchanger comprises a housing 1 which is formed by four outer walls 2 and between which extend horizontal walls 3 and vertical walls 4. Ducts 5 are formed between each pair of horizontal walls 3 and vertical walls 4. As can be seen in FIG. 4, ducts of the first type, which are shown in light gray in FIG. 4, adjoin on four sides ducts of the second type which are shown in dark gray in FIG. 4.

The advantages set forth in the preamble are achieved with this configuration. The construction as elucidated with reference to FIG. 4 is applied in similar manner in the configurations according to FIGS. 1, 2 and 3.

It will be apparent that it is necessary that the supply and discharge of the media to and from the ducts thus arranged in a chess board pattern must take place separately. For supplying or discharging the media use is preferably made of a connecting piece as designated with 6 in FIG. 5. The connecting piece 6 comprises a first part 7 extending from housing 1 to a boundary plane 8. The first part of the connecting piece herein has a configuration such that each connecting duct forming part of each second column extends in the line of the ducts 5 of housing 1, while the duct forming part of the other columns extend obliquely downward so that at the position of the boundary plane 8 they are displaced over the height of a duct. This configuration results in connecting ducts leading to ducts of the same type being located in rows and no longer arranged, as at the boundary plane between housing 1 and the first part of the connecting piece, in a chess board pattern. A joint arrangement is thus already obtained in a first dimension.

For the arrangement into the second dimension use is made of a second part 9 formed by a insert piece 10 and a housing 11. The insert piece 10 has a triangular section in top elevation and is formed by a number of triangular plates 12 extending mutually parallel and at a mutual distance, which plates are connected alternatingly on their short sides by rectangular plates 13.

The housing 11 is formed by a rectangular casing opened on one side which is provided with two connecting openings 14, 15 respectively. Thus combining the components described and shown in FIG. 5 results in a combination of a heat exchanger and a connecting piece 6. It will be apparent that a corresponding connecting piece 6 will be arranged on the other side for supplying or discharging on the other side of the heat exchanger the media to be subjected to heat exchange. It is possible to turn the first part 7 through 90°. In order to arrive in such a situation at a good arrangement, that is, a good separation of both media, it is important to likewise turn the second part 9 through 90°.

Figure 7:
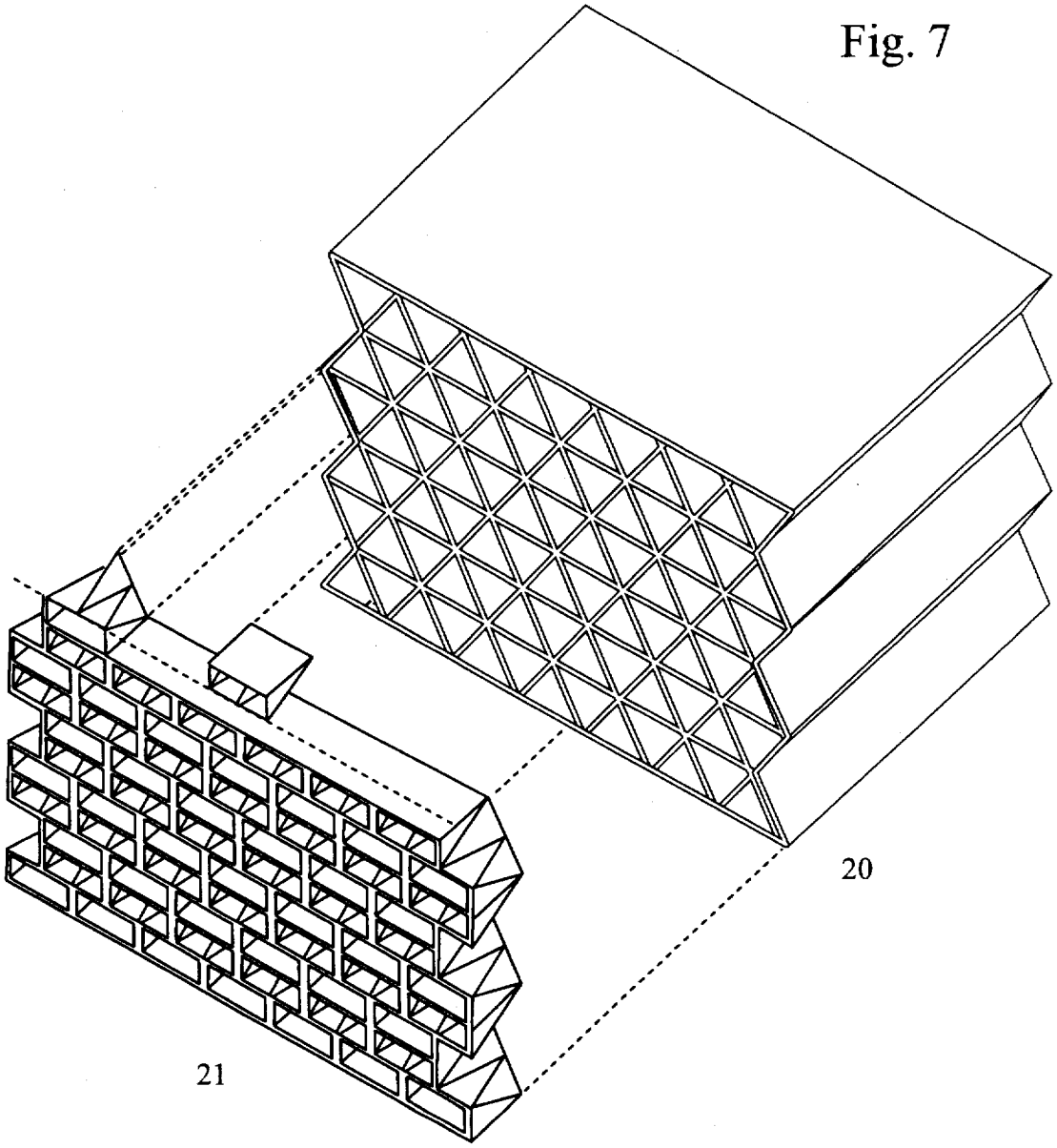
FIG. 7 shows a perspective view exploded in one dimension of another preferred embodiment of the heat exchanger according to the present invention.

For the heat exchanger consisting of triangular ducts a connecting piece with the same function as part 7 in FIG. 5 can be made, such as is shown as part 21 in FIG. 7. Such a connecting piece comprises connecting ducts each connecting onto an end of the ducts located on one side of the heat exchanger and extending to a boundary plane, wherein the form of each of the connecting ducts changes from triangular at connection of the ducts to rectangular on the boundary plane, wherein one of the long sides of the rectangular section is located in the continuation of one of the boundary planes between ducts.

Figure 8:
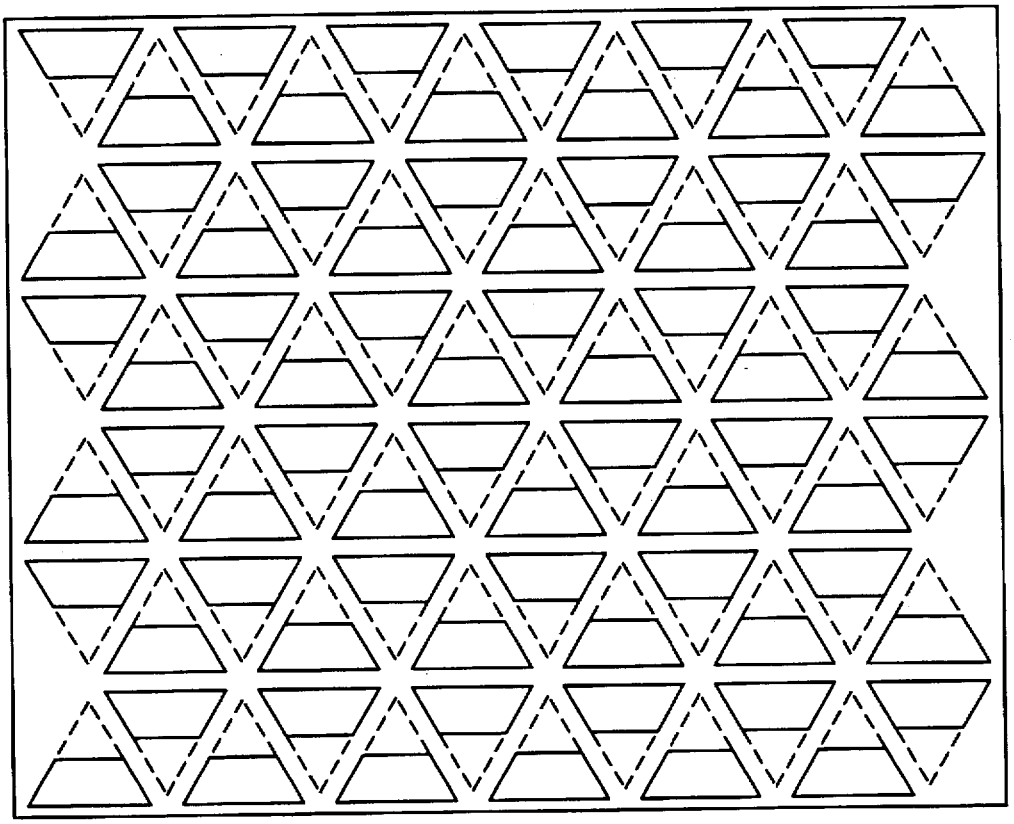
FIG. 8 is a sectional view of a first embodiment of the first part of the connecting piece of the heat exchanger according to the present invention.
Figure 9:
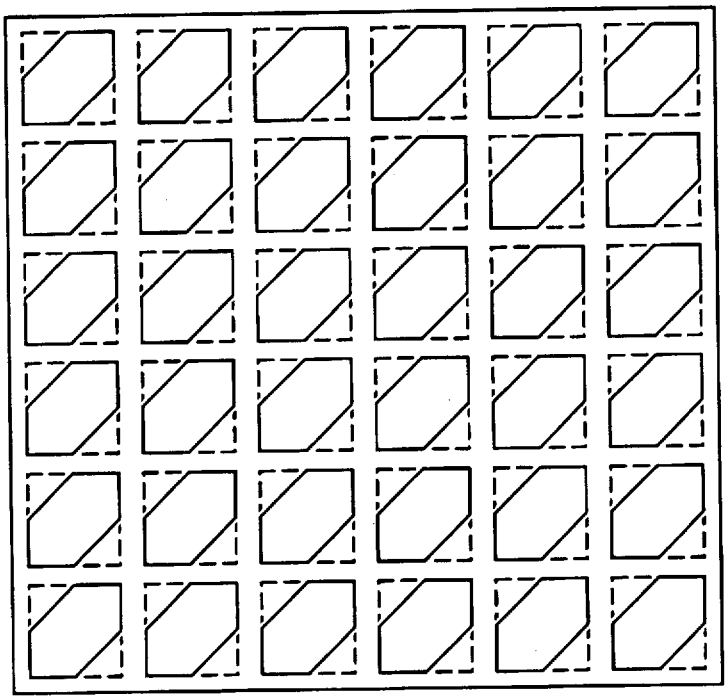
FIG. 9 shows a sectional view of a fourth embodiment of the first part of the connecting piece of the heat exchanger according to the present invention.

The same function as that of connecting piece 21 can be made more simply by arranging a plate provided with openings on the end of the ducts, wherein the openings are arranged such that openings connected to ducts of the same type are arranged in straight lines and that all openings leading to ducts of the same type are connected to a manifold. Such a plate for ducts of a triangular configuration is shown in FIG. 8. With such an embodiment some extra flow loss occurs. The same simplification can also be applied to the heat exchanger consisting of rectangular ducts, as can be seen in FIG. 9.

In another embodiment of the invention the actual recuperator 20 is formed by a number of plates each of which is bent in substantially zigzag form. These plates can be formed by rigid plates but can equally be formed by more flexible material. On their ends each of the adjoining plates are mutually joined at a weld. It is likewise possible to perform a fixing at the intermediate locations where the successive plates 25 make mutual contact, although this is not per se necessary for sealing purposes; such a connecting weld in any case only separates ducts of the same type.

For connection of such a configuration use is made of a connecting piece 21 formed by deformed parts of the plates. The remaining part of the connecting piece is formed normally in the manner already described with reference to the preceding embodiments.

The invention is not however limited to the said configuration of connecting pieces; it is possible to apply connecting pieces formed in other manner, for instance by connecting hoses to each of the ducts.

Figure 6:
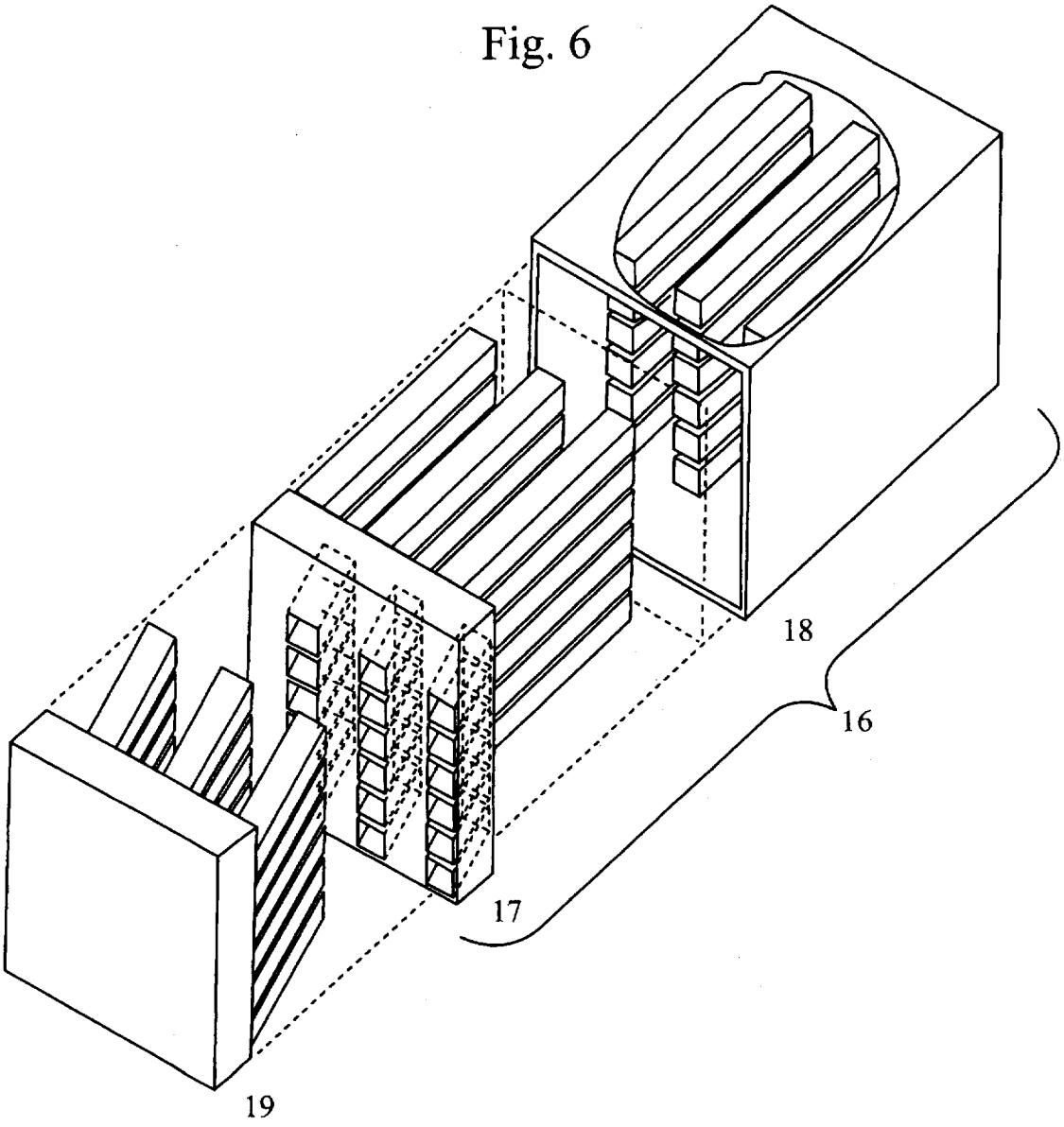
FIG. 6 shows a pressing mould exploded in one dimension for manufacturing a heat exchanger according to the present invention.

In order to manufacture such a configuration use can be made of the mould 16 and the component 19 shown in FIG. 6. This is preferably used in injection moulding, wherein the components 17 and 18 of the mould 16 are pushed into one another and the plastic from which the heat exchanger must be produced is supplied via a connecting piece (not shown in the drawing). After the plastic has been supplied and has set to a sufficient extent the component 19 is removed from the mould and subsequently the component 17.

It is however possible to manufacture the combination of a connecting piece and an actual heat exchanger in other ways.

Another advantage of manufacturing a connecting piece in this manner is the fact that because the same material is used, mechanical and thermal stresses in the material are avoided.

I claim:

1. Heat exchanger comprising ducts (5) of a first type and ducts (5) of a second type, the ducts (5) of both types having an identical cross-section, being parallel and at least partially mutually adjacent arranged in a housing (1), and in cross-section arranged in a regular pattern, the ducts (5) being separated by separating walls (3,4) wherein substantially each of the separating walls (3,4) is bounded on at least one side by a duct (5) of the first type and by a duct (5) of the second type at the other side, the heat exchanger comprising at least one connecting piece (6) adapted for connecting one end of the ducts (5) of the first type to a first connection (14) and one end of the ducts of the second type to a second connection (15), characterized in that substantially each of the sides of the duct of the first type is adjacent to a side of a duct of a second type and ducts of both the first and second types each have the cross-section of an isosceles triangle, characterized in that the connecting piece comprises a plate provided with openings and arranged on the end of the holder, wherein the openings are arranged such that openings connected to ducts of the same type are arranged in straight lines and that all openings leading to ducts of the same type are connected to a manifold.

2. Heat exchanger comprising ducts (5) of a first type and ducts (5) of a second type, the ducts (5) of both types having an identical cross-section, being parallel and at least partially mutually adjacent arranged in a housing (1), and in cross-section arranged in a regular pattern, the ducts (5) being separated by separating walls (3,4) wherein substantially each of the separating walls (3,4) is bounded on at least one side by a duct (5) of the first type and by a duct (5) of the second type at the other side, the heat exchanger comprising at least one connecting piece (6) adapted for connecting one end of the ducts (5) of the first type to a first connection (14) and one end of the ducts of the second type to a second connection (15), characterized in that substantially each of the sides of the duct of the first type is adjacent to a side of a duct of a second type and ducts of both the first and second types each have the cross-section of an isosceles triangle, characterized in that the connecting piece (6) comprises a first part (7) and a second part (9) separated by a boundary plane (8), and wherein connecting ducts are arranged in the first part (7) each of the connecting ducts being on one side connected with the ducts of the first or the second type and on the other side leading to a first side of said boundary plane, the connecting ducts being arranged such that the connecting ducts connected with the ducts of the first type are arranged in columns or rows at the boundary plane, and that the second part, on a second side of the boundary plane comprises a manifold connecting the rows or columns at the boundary plane with the connections of the first or second type, anal wherein the form of each of the connecting ducts changes from triangular at connection of the ducts to rectangular at the boundary plane, and wherein one of the long sides of the rectangular cross-section is located in the continuation of one of the boundary planes between ducts.

* * * * *